United States Patent [19]

Durney

[11] Patent Number: 4,603,719

[45] Date of Patent: Aug. 5, 1986

[54] DRILLING AND COUNTERBORING APPARATUS AND METHOD FOR TOE FASTENING

[76] Inventor: Max W. Durney, 417 E. D St., Petaluma, Calif. 94952

[21] Appl. No.: 784,152

[22] Filed: Oct. 4, 1985

[51] Int. Cl.[4] ..... B27M 1/08; B27C 1/00

[52] U.S. Cl. ..... 144/365; 29/33 R; 144/3 R; 144/93 R; 144/134 R; 144/367; 408/26; 409/199

[58] Field of Search ..... 409/126, 130, 199, 92; 29/526 R, 33 R; 144/1 R, 3 R, 93 R, 103, 134 R, 365, 367, 371; 408/26, 30

[56] References Cited

U.S. PATENT DOCUMENTS 1,335,544 3/1920 Anders .
1,602,658 10/1926 Germain .
3,496,974 2/1970 Munsil et al. .
3,675,312 7/1972 Herman .

*Primary Examiner*—W. D. Bray
*Attorney, Agent, or Firm*—Manfred M. Warren; Robert B. Chickering; Glen R. Grunewald

[57] ABSTRACT

A method and apparatus for forming a counterbore and a bore in a workpiece for toe fastening of the piece to a second member is disclosed. The apparatus includes a router mounted with its cutting bit transverse to the workpiece so that the bit may be progressively urged into the workpiece surface to produce a shallow counterbore. Additionally, a drillbit is mounted so that it can be urged from the edge of the workpiece in an opposite direction toward the counterbore to produce a fastener receiving bore which communicates with the counterbore. The router and drill are mounted on a common carriage, and in one embodiment the carriage is pivoted, while in another it is slid, in opposite directions to produce the counterbore and bore. A method of forming the bore and counterbore is also disclosed.

14 Claims, 12 Drawing Figures

DRILLING AND COUNTERBORING APPARATUS AND METHOD FOR TOE FASTENING

BACKGROUND OF THE INVENTION

The present invention relates, in general, to apparatus and methods for joining together wooden, plastic and particle board workpieces and, more particularly, relates to apparatus suitable for forming obliquely oriented counterbores and fastener receiving bores to allow toe-fastening together of two members.

There are many applications in joinery in which two members must be secured together by fasteners in such a way that the fastening elements are not visible from the outside surfaces of the resulting structure. In U.S. Pat. No. 3,496,974, for example, a stepped drill bit is disclosed which is suitable for forming a counterbore and fastener receiving bore in the back side of a wooden member proximate the edge thereof to permit the formation of a face frame. The counterbore and the screw receiving bore are both formed at a relatively shallow angle (or oblique angle if measured from the drill axis in the direction of advancement of the drill) with respect to the back surface of the member being drilled proximate an edge thereof. A screw positioned in the screw receiving bore hole and extends outwardly of the edge of the member to permit threading of the screw into a second member. As shown in U.S. Pat. No. 3,496,974, the members are oriented in substantially the same plane and joined together in abutting relation. It is also possible to use this same toe-fastening approach to join one member in a perpendicular orientation to another member.

U.S. Pat. No. 3,675,312 discloses an alternative apparatus and process for joining together two members in perpendicular relation to each other. This approach also employs an obliquely oriented tool access hole and a large counterbore which is drilled into the edge of the member which will carry the screw. An annular insert is then adhesively secured in the counterbore with the screw in the central bore of the insert, and the access opening is used to drive the screw into the second member.

It is very difficult, however, to drill a counterbore at a shallow or oblique angle with respect to a workpiece. The drill will tend to wander, more particularly it will be deflected toward a parallel orientation with the surface as it enters. The bore that is cut is very often ragged and characterized by chipping. For particle board and hardboard, as well as very hard lumber, drilling at a shallow angle, even with jigs or fixtures, is almost impossible. Similarly, for plastics having low friction surfaces it is extremely difficult to start a stepped drill having a configuration as shown in U.S. Pat. No. 3,496,974.

The approach shown in U.S. Pat. No. 3,675,312 has the disadvantage of requiring a separate insert piece which must be secured by a separate process, as well as a specialized tool. Moreover, the time required to form a joint is undesirably long. Other even more complex face-framing apparatus can be seen in U.S. Pat. Nos. 1,335,544 and 1,602,658.

OBJECTS AND SUMMARY OF THE INVENTION

A. Objects of the Invention

Accordingly, it is an object of the present invention to provide an apparatus and method for forming an obliquely oriented counterbore and fastener receiving bore which is suitable for use in hard woods, particle board, hardboard and plastics and laminated plastic and substrate products.

It is another object of the apparatus and method of the present invention to provide a system which is capable of counterboring at a relatively shallow angle to minimize the relative shifting or dislocation which can occur during fastening to less than one-half the dislocation which occurs when conventional step drills are employed and to thereby minimize the need and complexity of the fastening clamping structures.

It is a further object of the present invention to provide an apparatus and method for forming a counterbore and bore which is obliquely oriented to the surface of the workpiece which has greatly improved precision and accuracy.

A further object of the present invention is to provide a method and apparatus for the formation of an obliquely oriented counterbore and fastener receiving bore which can be rapidly and efficiently formed, does not chip or tear the surface adjacent the counterbore, can be used by relatively unskilled personnel, and is accurate enough to receive a cover plate.

The apparatus and method of the present invention have other objects and features of advantage which will become more apparent from and are set forth in more detail in the following description of the preferred embodiments and the accompanying drawings.

B. Summary of the Invention

The apparatus of the present invention comprises, briefly, a surface for supporting the workpiece, a router movably mounted to the apparatus and oriented with the axis of rotation of the cutting bit transverse to the surface to be cut and generally perpendicular to the direction or motion of the router. The router is mounted for movement at an oblique angle to the surface of the workpiece proximate an edge for movement to cut an inwardly increasing, tapered recess in the surface terminating in a shoulder transverse to the surface proximate and in spaced relation to the edge of the workpiece. The apparatus further includes a drill movably mounted to the apparatus and oriented with an axis of rotation generally parallel to the direction of motion of the drill and approximately perpendicular to the axis of rotation of the router. The drill is mounted for movement in a direction to drill a fastener receiving bore from the edge of the workpiece into the workpiece a distance at least equal to the distance between the shoulder formed or to be formed by the router and at a depth from the surface less than the depth of the counterbore to permit seating of the fastener head. In the preferred form, the router and drill are mounted on a common pivotally mounted carriage that is swung in one direction to form the counterbore and then pivoted in the opposite direction to form the fastener receiving bore.

The method of forming an obliquely oriented counterbore in a surface proximate the edge of the workpiece and of forming a connecting fastener receiving bore between the counterbore and the edge is comprised, briefly, of the steps of: advancing a router oriented with the axis of rotation of the cutting bit of the router transverse to the surface in which the counterbore is to be formed and along a path at an oblique angle to the surface to progressively cut an inwardly tapering counterbore in the surface which terminates in a transverse shoulder; and advancing a drill from the edge of the workpiece inwardly into the workpiece a distance slightly greater than the distance between the edge and the shoulder and at a depth slightly less than the depth of the counterbore.

DESCRIPTION OF THE PREFERRED EMBODIMENT

Figure 1:
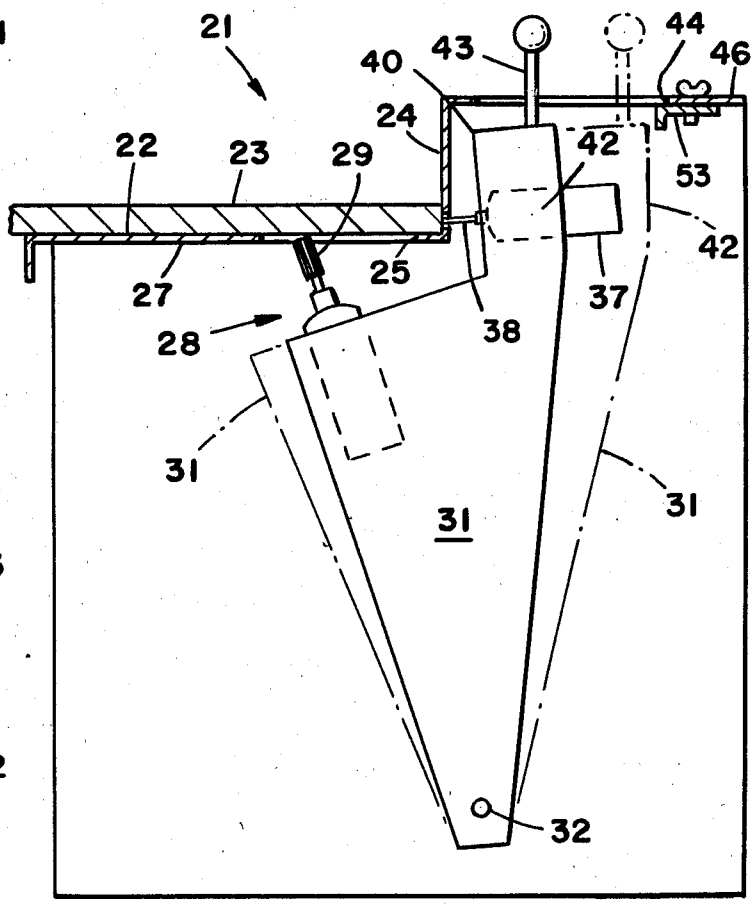
FIG. 1 is a side elevation, schematic representation in cross section of counterboring and drilling apparatus constructed in accordance with the present invention.
Figure 2:
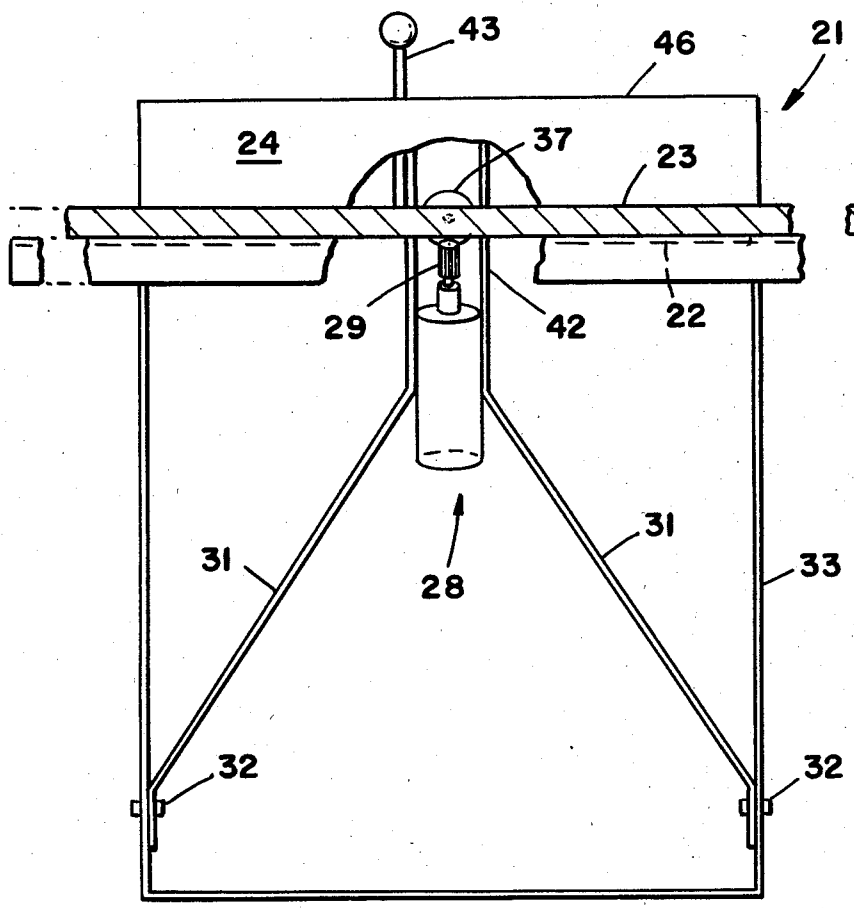
FIG. 2 is a front elevation view in cross section and partially broken away of the apparatus of FIG. 1.
Figure 3:
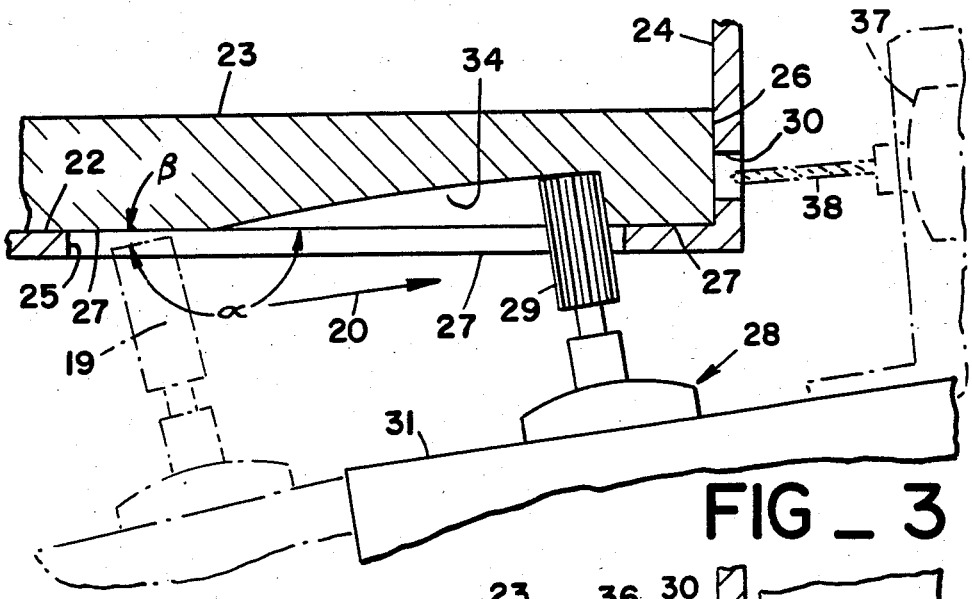
FIG. 3 is an enlarged, fragmentary, side elevation view in cross section of the apparatus while cutting a counterbore in a workpiece.
Figure 4:
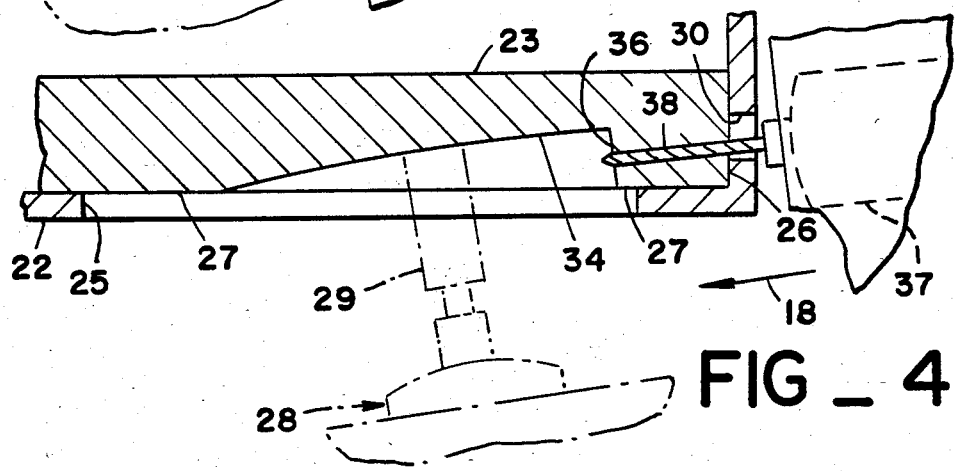
FIG. 4 is a fragmentary, enlarged, side elevation view in cross section corresponding to FIG. 4 showing a drilling operation.

The counterfore and fastener bore forming apparatus of the present invention can be described in detail by reference to FIGS. 1 through 4. As will be seen, the apparatus, generally designated 21, includes a support surface or table 22 formed for support of workpiece 23 in a position for formation of a counterbore and fastener receiving bore. Preferably, the table includes a step or shoulder 24 against which an edge 26 (FIG. 3) can be abutted so as to allow the operator to locate the workpiece in a position for cutting. The workpiece should be clamped to table 22 by clamping means (not shown) to hold the work in indexed relation against shoulder or wall 24.

Instead of attempting to drill at a shallow or oblique angle with respect to the workpiece surface 27, the apparatus of the present invention is formed to orient the counterbore forming bit transverse to surface 27. As may be seen in FIGS. 3 and 6, the angle between the plane of entry into the workpiece and surface 27 of the workpiece in the direction of arrow 20, the direction of motion of the router, is an "oblique" angle. The complimentary angle is also sometimes referred to as a "shallow" angle. For the purposes of this application "oblique" shall refer to angle and "shallow" to the angle.

Movably mounted to apparatus 21 is a router means, generally designated 28, having a cutting bit 29 with an axis of rotation 19 generally perpendicular to the direction of motion 20 of the router means. Thus, router means 28 is shown mounted to a pair of arms 31 which are pivoted at 32 to the side frame members 33 of counterbore and bore fastening apparatus 21. As arms 31 are pivoted about pivot points 32, therefore, the router is swung up through a slot 25 in table 22 into engagement with surface 27 of the workpiece. As will be seen in FIG. 3, the router progressively is moved toward and into the workpiece to cut an inwardly tapered, slightly curved recess 34 in surface 27 proximate edge 26 of the workpiece. The result is a machining action in which router bit 29 is able to gradually enter workpiece 22 at angle without chipping the workpiece and without wandering or being deflected by the shallow angle of recess 34. Thus, instead of trying to form counterbore 34 with a tool that rotates with an axis virtually parallel to workpiece surface 27 (for example as is required with the apparatus of U.S. Pat. No. 3,496,974), the axis of bit 29 is transverse and almost perpendicular to surface 27 permitting it to progressively enter the surface at an oblique angle. The arcuate motion of carriage means 31 produces an arcuate recess 34, which has the desirable effect of shortening the length of the recess.

The tapered cut 34 formed by router bit 29 terminates in a curved shoulder 36 (FIG. 5) which is in generally perpendicular to surface 27 and approximately parallel and in spaced relation to edge 26 of the workpiece. Shoulder 36 provides a surface against which the fastener head can bear once a fastener receiving bore is formed between shoulder 36 and edge 26.

In the counterboring and drilling apparatus of the present invention the apparatus further includes drill means, generally designated 37, oriented with an axis of rotation generally parallel to the direction of motion 18 (FIG. 4) of the drill means and generally perpendicular to the axis of rotation 19 of router 28. Thus, drill means 37 includes a drill bit 38 mounted for movement in a direction to drill a bore 39 through opening 30 in wall 24 from edge 26 into the workpiece edge a distance at least equal to the distance between edge 26 and shoulder 36. Moreover, the depth from surface 27 at which drill bit 38 drills a bore into the workpiece is slightly less than the depth of counterbore 34 so that there will be an opening 41 (FIG. 5) of bore 39 in shoulder 36 which will allow the bore to communicate with the counterbore and room for the fastener head when the fastener is inserted into bore 39.

Bore 39 can be at an angle of about 8 degrees to surface 27 to minimize shifting or dislocation of pieces when formed together. Additionally, bore 39 can have a diameter which substantially matches the fastener diameter to improve the shear characteristics of the resulting joint. Prior art systems have had to employ over-sized drill bits to withstand the bending stress, resulting from drilling at shallow angles.

In the preferred form of the apparatus shown in FIGS. 1–4, drill means 37 is mounted to the same pair of arms 31 as is router 28. Thus, an upwardly extending pair of drill support flanges 42 are provided on arms 31 to carry drill means 37. Thus, the apparatus includes common carriage means 31 which is formed to move the router and drill in opposite directions by pivoting the arms or carriage 31 about axis 32. Control of this movement can advantageously be provided by a manually engageable lever arm 43 which extends up through a slot 44 in top surface 46 of the housing of apparatus 21. The operator, therefore, can use lever 43 to form counterbore 34 by pivoting the carriage means 31 to the right as shown in FIG. 1, and can form bore 39 by pivoting the carriage to the left as show in FIG. 1.

As will be understood, movement of carriage means 31 also could be automated through the use of a mechanical, pneumatic or hydraulic actuator means (not shown). Such automation of the apparatus is particularly desirable when multiple counterboring and bore drilling assemblies are ganged together for production runs.

Figure 5:
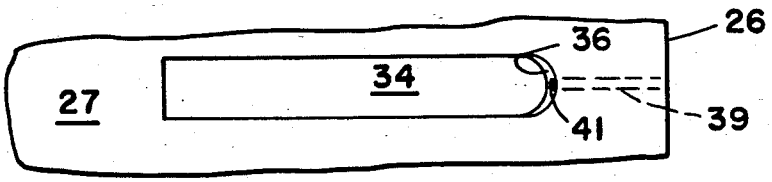
FIG. 5 is a fragmentary, bottom plan view of the workpiece showing the counterbore and fastener receiving bore resulting from routing and drilling.
Figure 6:
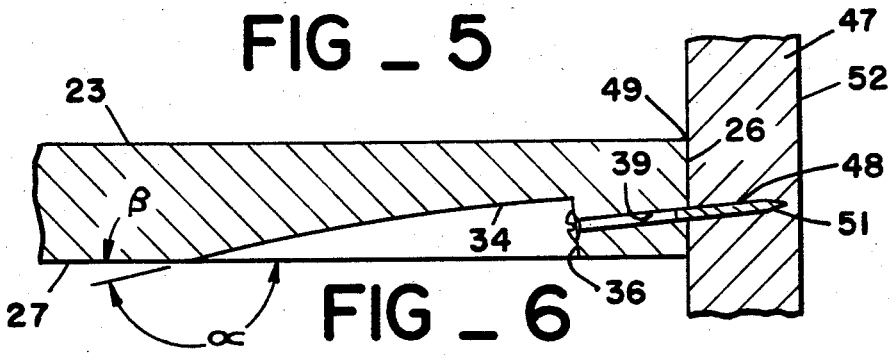
FIG. 6 is an enlarged, fragmentary, side elevation view in cross section of the workpiece as joined to a second member.
Figure 7:
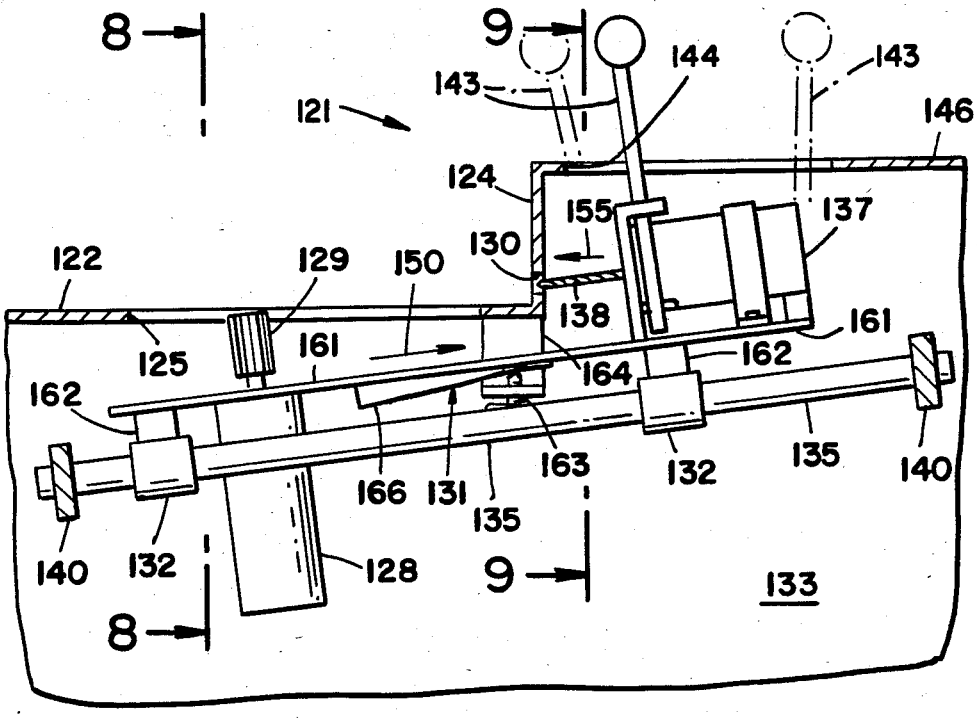
FIG. 7 is a fragmentary, side elevation view in cross section of an alternative embodiment of the routing and drilling apparatus of the present invention.

The resultant workpiece produced by the apparatus of the present invention is seen in FIGS. 5 and 6. Once the counterbore and fastener receiving bore are formed, the workpiece edge 26 can be abutted up against a second member 47 and a fastener, for example a screw 48, can be used to join workpiece 23 to second member 47. As shown in FIG. 6, second member 47 is perpendicuarly oriented to workpiece 23, but it will be understood that the second member can also lie in the same plane as workpiece 23, for example, in the formation of a face frame. Similarly, second member 47 can terminate in an edge at 49 which is flush with the top surface of workpiece 23 so as to form a corner joint.

It is an important feature of the apparatus and method of the present invention that it permits end 51 of fastener 48 to extend very close to the outside surface 52 of the second member for full engagement of the fastener threads. This can only be accomplished if the distance between shoulder 36 and edge 26 can be carefully controlled. The use of a router oriented transverse to the workpiece in order to form counterbore 37 allows a high degree of accuracy in controlling the distance between edge 26 and shoulder 34. Accordingly, fastener 48 will reproducibly extend into second member 47 a distance which can be very close to but not extend through surface 52. This distance can be controlled by adjustable stop means 53 provided proximate slot 44 so as to engage at least one of flanges 42.

Forward pivoting of carriage mean 31 is less critical since drill bit 38 can drill through its the counterbore recess. As shown in FIG. 1, the forward edge 40 of flanges 42 engages the back side of wall 24 to limit forward pivoting.

An alternative embodiment of the counterbore and bore forming apparatus to the present invention is shown in FIGS. 7 through 12. Apparatus 121 again is preferably formed with a table 122 on which workpiece 123 can be urged against step or shoulder 124. Mounted below table 122 is a movable carriage means, generally designated 131, which carries router 128 and drill 137. Carriage means 131 may be mounted by slidable collars 132 on guide means or bar 135, which is secured by frame members 140 to side walls 133 of the (or, if desired, to the top walls of the apparatus) apparatus.

In order to form a counterbore 134 in workpiece 123, router bit 129 is advanced up through slot or opening 125 in the worktable in the direction as indicated by arrow 150. Once the counterbore is formed, carriage 131 and drill bit 138 can be advanced in the direction of arrow 155 so that the drill bit extends through opening 130 and into the workpiece to form fastener receiving bore 139. Control of the reciprocation of carriage 131 along guide bar 135 is accomplished by manual engageable lever 143 which extends upwardly through slot 144 in the top surface 146 of the apparatus. As best may be seen in FIGS. 10 and 11, it is preferable that slot 144 through which manual engageable lever 143 extends be formed with a notched section 160 toward which lever 143 can be biased by spring means (not shown). The notched section 160 is positioned to provide a neutral position in which neither the router bit 129 nor the drill bit 138 engages the workpiece. Thus, the lever can be positioned in the neutral position of notch 160 at the start of formation of the counterbore and bore.

Figure 8:
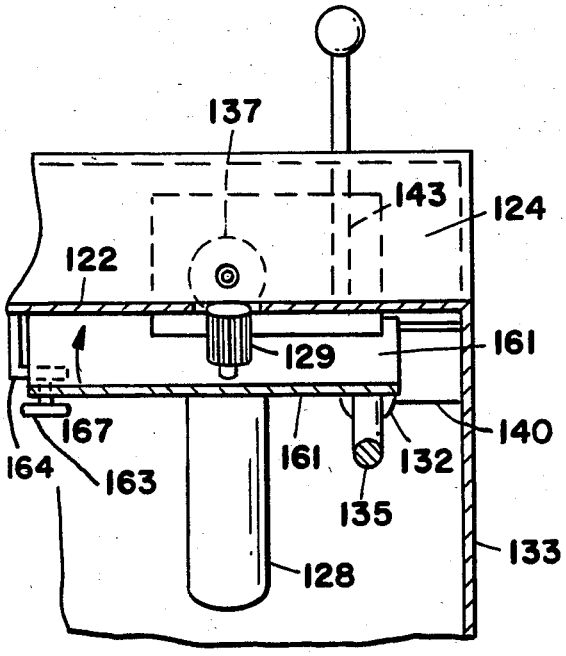
FIG. 8 is a fragmentary, end elevation view taken substantially along the plane of line 8—8 in FIG. 7.
Figure 9:
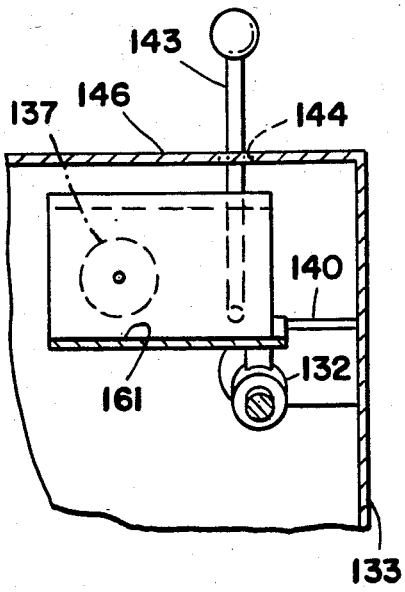
FIG. 9 is a fragmentary, end elevation view taken substantially along the plane of line 9—9 in FIG. 7.
Figure 10:
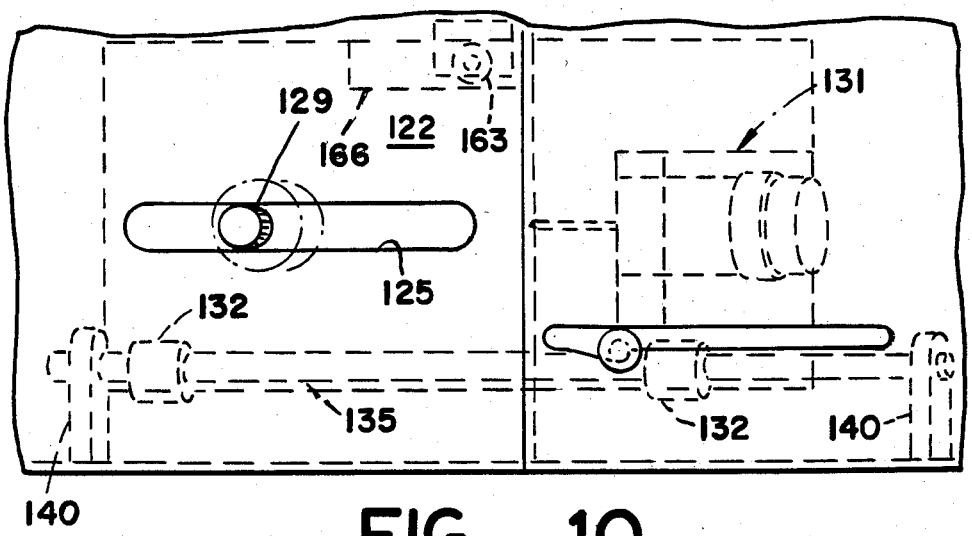
FIG. 10 is a fragmentary, top plan view of the apparatus of FIG. 7.
Figure 11:
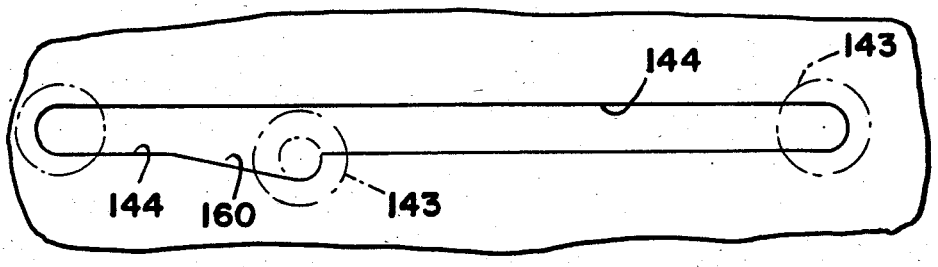
FIG. 11 is a fragmentary, enlarged, top plan view of the control lever section of FIG. 10
Figure 12:
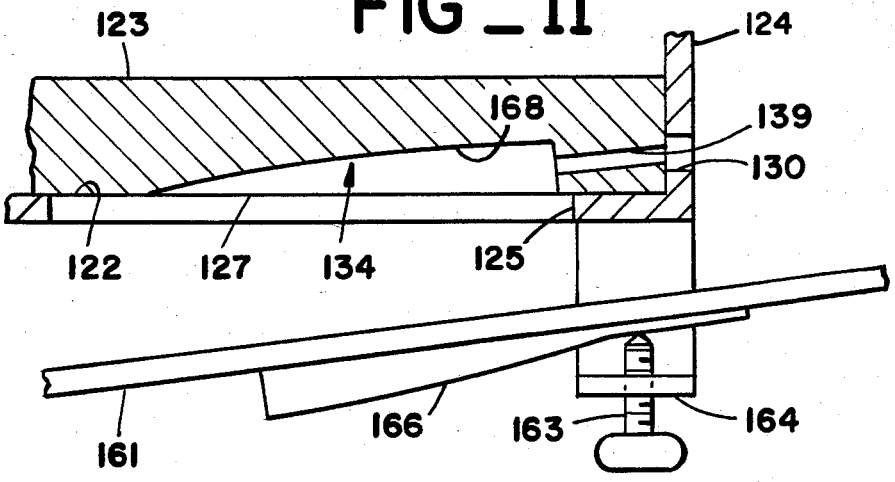
FIG. 12 is a fragmentary, enlarged, side elevation view of the apparatus of FIG. 7 showing the workpiece after routing and drilling.

It is a further feature of the apparatus of FIGS. 7–12 that the carriage is mounted for guided movement in a manner which will increase the angle at which the counterbore is formed. Thus, router 128 is mounted to a plate 161 which in turn is mounted by flanges 162 to the slidable bushings 132. Bushings 132, as best may be seen in FIGS. 8 and 9, are only on one side of plate 161, and the opposite side of plate 161 is slidingly supported on adjustable threaded member 163 which extends to L-shaped bracket 164. In order to effect a change in the angle of counterbore 134, a wedge-shaped cam surface 166, which preferably is slightly arcuate, is provided on the underneath side of plate 161. As threaded member 163 engages inclined surface 166, plate 161 is pivoted about guide rod 135 in the direction of arrow 167 (FIG. 8). This changes the angle of incline in counterbore 134 to produce a section 168 which is initially somewhat less parallel to the surface 127 so as to reduce the length required for the center bore while still allowing the fastener bore 139 to be drilled at a shallow angle. The more shallow the angle of bore 139, the less will be the tendency for the pieces to shift or dislocate upon fastening together, which in turn minimizes clamping requirements during fastening.

The method of forming a counterbore and bore of the present invention can be performed by either of the apparatus illustrated. It includes the steps of advancing router means oriented with the axis of rotation of the cutting bit of the router transverse to the surface in which the counterbore is to be formed and along a path to progressively cut an tapered counterbore in the workpiece surface which terminates in a transverse shoulder. The method further includes the step of advancing drill means from the edge of the workpiece inwardly into the workpiece from the edge to the counterbore.

As will be appreciated, the step of advancing the drill means can be accomplished either before or after the step of advancing the router, so long as the counterbore and fastener receiving bore are formed for communication with each other. As is the case for the apparatus shown in the drawing, the router and drill means advancing steps are accomplished by advancing the respective tools in directions which oppose each other, and the steps are most preferably accomplished by sequentially reciprocating a common carriage on which the router and drill are mounted. The carriage can be pivoted or slid in opposite directions to effect the formation of the combination counterbore and bore.

Mounting the router and drill to a common carriage insures arcuate relative indexing of the locations of the counterbore and bore and further insures that the tools do not interfere with the operation of each other.

The method and apparatus of the present invention can be used to form a bore and counterbore in relatively hard materials such as particle board, hardboard and high-pressure plastic laminates. Moreover, extremely accurate bore and counterbore cuts can be made in plastics having low friction surfaces. Additionally, the low or shallow angle of the fastener receiving bore allows a minimal clamping structure to be used to control shifting or the dislocation of the parts being fastened. The apparatus and method can also be used by relatively unskilled production personnel as well as journeyman carpenters, and it is adaptable to adjustment as to the depth of the counterbore and diameter of the fastener receiving bore.

What is claimed is:

1. Apparatus for forming an obliquely oriented counterbore in a surface of a workpiece and a fastener receiving bore proximate an edge of said workpiece comprising:

(a) means associated with said apparatus for supporting said workpiece in a position for formation of said counterbore and said bore;

(b) router means movably mounted to said apparatus and oriented with the axis of rotation of the cutting bit of said router means generally perpendicular to the direction of motion of said router means, said router means being mounted for movement progressively inwardly to cut a tapering recess in said surface terminating in a shoulder transverse to said surface proximate and in spaced relation to said edge to form said obliquely oriented counterbore; and (c) drill means movably mounted to said apparatus and oriented with the axis of rotation generally parallel to the direction of motion of said drill means and generally perpendicular to said axis of rotation of said router means, said drill means being mounted for movement in a direction to drill said bore from said edge into said workpiece a distance and direction causing said bore to communicate with said counterbore.

2. The apparatus as defined in claim 1 wherein, said router means and said drill means are mounted to said apparatus for movement in opposed directions.

3. The apparatus as defined in claim 1 wherein, said router means and said drill means are mounted to a common movable carriage means, said carriage means being mounted to said apparatus for movement in one direction to effect routing and for movement in a generally opposed direction to effect drilling.

4. The apparatus as defined in claim 3 wherein, said apparatus includes guide means, and said carriage means is slidably mounted to said guide means.

5. The apparatus as defined in claim 4 wherein, said guide means is formed to provide a substantially linear guide for said carriage means.

6. The apparatus as defined in claim 5 wherein, said carriage means is mounted to said guide means for pivoting about an axis parallel to the direction of movement along said guide means, and said guide means includes a cam surface formed and positioned to pivot said carriage means during a portion of the distance of movement along said guide means to effect a change in the angle of incline of said counterbore.

7. The apparatus as defined in claim 3 wherein, said carriage means is pivotally mounted to said apparatus.

8. The apparatus as defined in claim 1 wherein, said means for supporting said workpiece includes means for positioning said edge in indexed relation to said router means and said drill means.

9. A method of forming an obliquely oriented counterbore in a surface proximate an edge of a workpiece and a connecting fastener receiving bore between said counterbore and said edge comprising the steps of:

advancing router means oriented with the axis of rotation of the cutting bit of said router transverse to said surface in which said counterbore is to be formed and along a path to progressively cut an inwardly tapering counterbore in said surface terminating in a transverse shoulder, and advancing drill means from said edge inwardly in said workpiece until said bore extends to a position which will communicate with said counterbore.

10. The method of forming a counterbore and bore as defined in claim 9 wherein, said advancing steps are accomplished by advancing said router means and said drill means in directions opposed to each other.

11. The method of forming a counterbore and bore as defined in claim 10 wherein, said router means and said drill means are mounted to a common carriage, and said advancing steps are accomplished sequentially by reciprocating said carriage.

12. The method of forming a counterbore and bore as defined in claim 11 wherein, said reciprocating step is accomplished by sliding said carriage along guide means.

13. The method of forming a counterbore and bore as defined in claim 12 wherein, during said sliding step, advancing said router means at a changed angle with respect to the direction of entry into said workpiece.

14. The method of forming a counterbore and bore as defined in claim 11 wherein, said reciprocating step is accomplished by pivoting said carriage about a pivotal axis.

* * * * *

UNITED STATES PATENT AND TRADEMARK OFFICE

CERTIFICATE OF CORRECTION

PATENT NO. : 4,603,719

DATED : August 5, 1986

INVENTOR(S) : Max W. Durney

It is certified that error appears in the above-identified patent and that said Letters Patent are hereby corrected as shown below:

Column 3, line 58, after "angle" insert the Alpha --- $\alpha$ ---;

Column 3, line 64, after "angle" insert the Alpha --- $\alpha$ ---;

Column 3, line 65, after "angle" and before the period insert the Beta --- $\beta$ ---;

Column 4, line 13, after "angle" insert the Beta --- $\beta$ ---.

Signed and Sealed this

Twenty-eighth Day of October, 1986

[SEAL]

*Attest:*

DONALD J. QUIGG

*Attesting Officer*

*Commissioner of Patents and Trademarks*